US011274558B2

(12) United States Patent
Bruni et al.

(10) Patent No.: US 11,274,558 B2
(45) Date of Patent: Mar. 15, 2022

(54) COMPRESSOR AEROFOIL

(71) Applicant: Siemens Energy Global GmbH & Co. KG, Munich (DE)

(72) Inventors: Giuseppe Bruni, Lincoln (GB); Senthil Krishnababu, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 16/753,846

(22) PCT Filed: Oct. 23, 2018

(86) PCT No.: PCT/EP2018/078972
§ 371 (c)(1),
(2) Date: Apr. 6, 2020

(87) PCT Pub. No.: WO2019/081471
PCT Pub. Date: May 2, 2019

(65) Prior Publication Data
US 2020/0362876 A1 Nov. 19, 2020

(30) Foreign Application Priority Data
Oct. 26, 2017 (EP) ..... 17198613

(51) Int. Cl.
*F01D 5/14* (2006.01)
*F01D 5/20* (2006.01)
(Continued)

(52) U.S. Cl.
CPC ..... *F01D 5/141* (2013.01); *F01D 5/20* (2013.01); *F01D 9/041* (2013.01); *F04D 29/324* (2013.01);
(Continued)

(58) Field of Classification Search
CPC ..... F04D 29/324; F04D 29/522; F01D 9/041; F01D 5/141; F01D 5/20; F05D 2220/32; F05D 2240/307; F05D 2250/184
See application file for complete search history.

(56) References Cited

U.S. PATENT DOCUMENTS 8,360,731 B2 * 1/2013 Nash ..... F01D 5/141 416/223 A
D777,212 S * 1/2017 Turuvekere Gurudatt ..... D15/5
(Continued)

FOREIGN PATENT DOCUMENTS

EP 2148042 A2 1/2010
EP 2514922 A2 * 10/2012 ..... F04D 29/023
(Continued)

OTHER PUBLICATIONS

PCT International Search Report and Written Opinion dated Jan. 16, 2019 corresponding to PCT/EP2018/078972 filed on Oct. 23, 2018.

*Primary Examiner* — Michael Lebentritt
*Assistant Examiner* — Brian Christopher Delrue

(57) ABSTRACT

A compressor aerofoil for a turbine engine includes a tip portion with a tip wall which extends from the aerofoil leading edge to the aerofoil trailing edge. The tip wall defines a squealer which extends between the leading edge the trailing edge. A shoulder is provided on one of the suction surface wall or pressure surface wall which extends between the leading edge and the trailing. A transition region tapers from the shoulder in a direction towards the tip wall. The other of the suction surface wall or pressure surface wall extends towards the tip wall.

21 Claims, 9 Drawing Sheets

(51) Int. Cl.

| | |
|---|---|
| ***F01D 9/04*** | (2006.01) |
| ***F04D 29/32*** | (2006.01) |
| ***F04D 29/52*** | (2006.01) |

(52) U.S. Cl.
CPC ..... *F04D 29/522* (2013.01); *F05D 2220/32* (2013.01); *F05D 2240/307* (2013.01)

(56) References Cited

U.S. PATENT DOCUMENTS

| | | | | |
|---|---|---|---|---|
| 9,856,739 | B2 * | 1/2018 | Bedrosyan | F01D 5/20 |
| 10,208,765 | B2 * | 2/2019 | Froebel | F01D 5/145 |
| 10,677,066 | B2 * | 6/2020 | Lewis | F04D 29/681 |
| 2006/0051209 | A1 * | 3/2006 | Lee | F01D 5/186 416/97 R |
| 2007/0258815 | A1 * | 11/2007 | Liang | F01D 5/20 416/97 R |
| 2011/0135482 | A1 * | 6/2011 | Nash | F01D 5/141 416/223 A |
| 2013/0266454 | A1 * | 10/2013 | Mongillo, Jr. | F01D 5/20 416/97 R |
| 2014/0119920 | A1 * | 5/2014 | Coull | F01D 11/08 416/182 |
| 2017/0145828 | A1 * | 5/2017 | Lewis | F02C 3/04 |
| 2017/0218976 | A1 * | 8/2017 | McGill | F04D 29/544 |
| 2021/0140324 | A1 * | 5/2021 | Bruni | F01D 5/20 |

FOREIGN PATENT DOCUMENTS

| | | | |
|---|---|---|---|
| EP | 2514922 | A2 | 10/2012 |
| EP | 3118413 | A1 | 1/2017 |
| RU | 124312 | U1 | 1/2013 |
| WO | 2011038971 | A1 | 4/2011 |

* cited by examiner $$W = \beta \cdot (W_A - W_{SA}) \left[ \left[ \sin \frac{\pi}{2\beta} \left( 1 - \frac{h}{(h_{1A} - h_g)} \right) \right] \right]^{\alpha}$$

where $1 \leq \alpha \leq 5$ and $1 \leq \beta \leq 5$

| Parameter | Value |
|---|---|
| $h_{2A}$ | 1.5 to 3.5 $h_g$ |
| $h_{1A}$ | 1.5 to 2.7 $h_{2A}$ |
| $W_{SA}$ | 0.3 to 0.6 $W_A$ |
| α | ≥1; ≤5 |
| β | ≥1; ≤5 |

$$W=\beta\cdot(W_A-W_{SA})\left[\left[\sin\frac{\pi}{2\beta}\left(1-\frac{h}{(h_{1A}-h_g)}\right)\right]^{\alpha}\right.$$

| Parameter | Value |
|---|---|
| $h_{2A}$ | 1.5 to $3.5h_g$ |
| $h_{1A}$ | 1.5 to $2.7h_{2A}$ |
| $W_{SA}$ | 0.3 to $0.6W_A$ |
| $\alpha$ | $\geq 1$; $\leq 5$ |
| $\beta$ | $\geq 1$; $\leq 5$ |

COMPRESSOR AEROFOIL

CROSS REFERENCE TO RELATED APPLICATIONS

This application is the US National Stage of International Application No. PCT/EP2018/078972 filed 23 Oct. 2018, and claims the benefit thereof. The International Application claims the benefit of European Application No. EP17198613 filed 26 Oct. 2017. All of the applications are incorporated by reference herein in their entirety.

FIELD OF INVENTION

The present invention relates to a compressor aerofoil.

In particular it relates to a compressor aerofoil rotor blade and/or compressor aerofoil stator vane for a turbine engine, and/or a compressor rotor assembly.

BACKGROUND

A compressor of a gas turbine engine comprises rotor components, including rotor blades and a rotor drum, and stator components, including stator vanes and a stator casing. The compressor is arranged about a rotational axis with a number of alternating rotor blade and stator vane stages, and each stage comprises an aerofoil.

The efficiency of the compressor is influenced by the running clearances or radial tip gap between its rotor and stator components. The radial gap or clearance between the rotor blades and stator casing and between the stator vanes and the rotor drum is set to be as small as possible to minimise over tip leakage of working gases, but sufficiently large to avoid significant rubbing that can damage components. The pressure difference between a pressure side and a suction side of the aerofoil causes the working gas to leak through the tip gap. This flow of working gas or over-tip leakage generates aerodynamic losses due to its viscous interaction within the tip gap and with the mainstream working gas flow particularly on exit from the tip gap. This viscous interaction causes loss of efficiency of the compressor stage and subsequently reduces the efficiency of the gas turbine engine.

Two main components to the over tip leakage flow have been identified, which is illustrated in FIG. 1, which shows an end on view of a tip 1 of an aerofoil 2 in situ in a compressor, thus showing a tip gap region. A first leakage component "A" originates near a leading edge 3 of the aerofoil at the tip 1 and which forms a tip leakage vortex 4, and a second component 5 that is created by leakage flow passing over the tip 1 from the pressure side 6 to the suction side 7. This second component 5 exits the tip gap and feeds into the tip leakage vortex 4 thereby creating still further aerodynamic losses.

Hence an aerofoil design which can reduce either or both tip leakage components is highly desirable.

SUMMARY

According to the present disclosure there is provided apparatus as set forth in the appended claims. Other features of the invention will be apparent from the dependent claims, and the description which follows.

Accordingly, there may be provided a compressor aerofoil (70) for a turbine engine. The compressor aerofoil (70) may comprise a tip portion (100) which extends from a main body portion (102). The main body portion (102) may be defined by: a suction surface wall (88) having a suction surface (89), a pressure surface wall (90) having a pressure surface (91), whereby the suction surface wall (88) and the pressure surface wall (90) meet at a leading edge (76) and a trailing edge (78). The tip portion (100) may comprise: a tip wall (106) which extends from the aerofoil leading edge (76) to the aerofoil trailing edge (78); the tip wall (106) defining a squealer (110) and has a tip surface. One of the suction surface wall (88) or pressure surface wall (90) may extend towards the tip wall (106) such that the respective suction surface (89) or pressure surface (90) extends to the tip wall (106). A shoulder (104, 105) may be provided on the other of the suction surface wall (88) or pressure surface wall (90), wherein the shoulder (104, 105) extends between the leading edge (76) and the trailing edge (78). A transition region (108, 109) may tapers from the shoulder (104, 105) in a direction to the tip wall (106). In cross-section, there is a smooth blend formed by the shoulder and the other of the suction surface wall or pressure surface wall and the transition region forms a discontinuous curve with the tip surface.

Preferably, the smooth blend (124) comprises an intersection (120) having an angle $\phi$ defined between a tangent (128) of the shoulder and a tangent (130) of the other of the suction surface wall (88) or pressure surface wall (90), wherein the angle $\phi$ is advantageously 0° and may be less than or equal to 5°.

Preferably, the discontinuous curve (126) comprises an intersection (122) having an angle $\theta$ between a tangent (132) of the transition region (104, 105) and a tangent (134) of the tip surface (118), each tangent is at the intersection (122), the angle $\theta$ is advantageously 90° and may be between 45° and 90°.

The shoulder (104) may be provided on the suction surface wall (88); and the pressure surface (91) extends to the tip wall (106).

The tip wall (106) may define a tip surface (118) which extends from the aerofoil leading edge (76) to the aerofoil trailing edge (78). The transition region (109) of the suction surface wall (88) may extend from the shoulder (104) in a direction towards the pressure surface (91), and at a suction side inflexion point (121) the transition region (109) may curve to extend in a direction away from the pressure surface (91) toward the tip surface (118).

The tip portion (100) may further comprise: a suction surface inflexion line (123) defined by a change in curvature on the suction surface (89); and the suction side inflexion point (121) being provided on the pressure side inflexion line (123); the suction side inflexion line (123) extending between the trailing edge (78) and the leading edge (76).

The shoulder (105) may be provided on the pressure surface wall (90). The suction surface (89) may extend to the tip wall (106).

The tip wall (106) may define a tip surface (118) which extends from the aerofoil leading edge (76) to the aerofoil trailing edge (78). The transition region (108) of the pressure surface wall (90) may extend from the shoulder (105) in a direction towards the suction surface (89), and at a pressure side inflexion point (120) the transition region (108) may curves to extend in a direction away from the suction surface (89) toward the tip surface (118).

The tip portion (100) may further comprise: a pressure surface inflexion line (122) defined by a change in curvature on the pressure surface (91); the pressure side inflexion point (120) being provided on the pressure side inflexion line (122); the pressure side inflexion line (122) extending between the leading edge (76) and the trailing edge (78).

The pressure surface (91) and the suction surface (89) are spaced apart by a distance $w_A$; the distance $w_A$, having a maximum value at a region between the leading edge (76) and trailing edge (78); the distance $w_A$ between the pressure surface (91) and the suction surface (89) decreasing in value from the maximum value towards the leading edge (76); and the distance $w_A$ between the pressure surface (91) and the suction surface (89) decreasing in value from the maximum value towards the trailing edge (78).

The tip wall (106) may increase in width $w_{SA}$ along its length from the leading edge (76); and may increase in width $w_{SA}$ along its length from the trailing edge (78).

The width $w_{SA}$ of the tip wall (106) may have a value of at least 0.3, but no more than 0.6, of the distance $w_A$.

There may also be provided a compressor rotor assembly for a turbine engine, the compressor rotor assembly comprising a casing (50) and a compressor aerofoil (70) according to the present disclosure, wherein the casing (50) and the compressor aerofoil (70) define a tip gap hg defined between the tip surface (118) and the casing (50). The tip gap hg is defined when the engine is operating and the compressor rotor assembly is relatively hot or at least when the engine is not cold or not operating.

There may also be provided a compressor rotor assembly according to the present disclosure wherein: the distance $h_{2A}$ from the inflexion line (122,123) to the casing (50) has a value of at least 1.5 hg but no more than 3.5 hg.

The shoulder (104, 105) may be provided a distance $h_{1A}$ from the casing (50); where $h_{1A}$ may have a value of at least 1.5, but no more than 2.7, of distance $h_{2A}$.

The distance "W" of a point on the transition region to the suction surface wall or pressure surface wall without the transition region for a given height "h" from the tip surface is defined by: where $\alpha$ has a value greater than or equal to 1 and advantageously less than or equal to 5 and advantageously in the range between 1.5 and 3; where $\beta$ has a value greater than 1, advantageously less than or equal to 5 and advantageously between 1 and 2.

Hence there is provided an aerofoil for a compressor which is progressively reduced in thickness towards its tip to form a squealer. This reduces the tip leakage mass flow thus diminishing the strength of the interaction between the leakage flow and the main stream flow which in turn reduces loss in efficiency relative to examples of the related art.

Hence the compressor aerofoil of the present disclosure provides a means of controlling losses by reducing the tip leakage flow.

BRIEF DESCRIPTION OF THE DRAWINGS

Examples of the present disclosure will now be described with reference to the accompanying drawings, in which.

DETAILED DESCRIPTION

Figure 2:
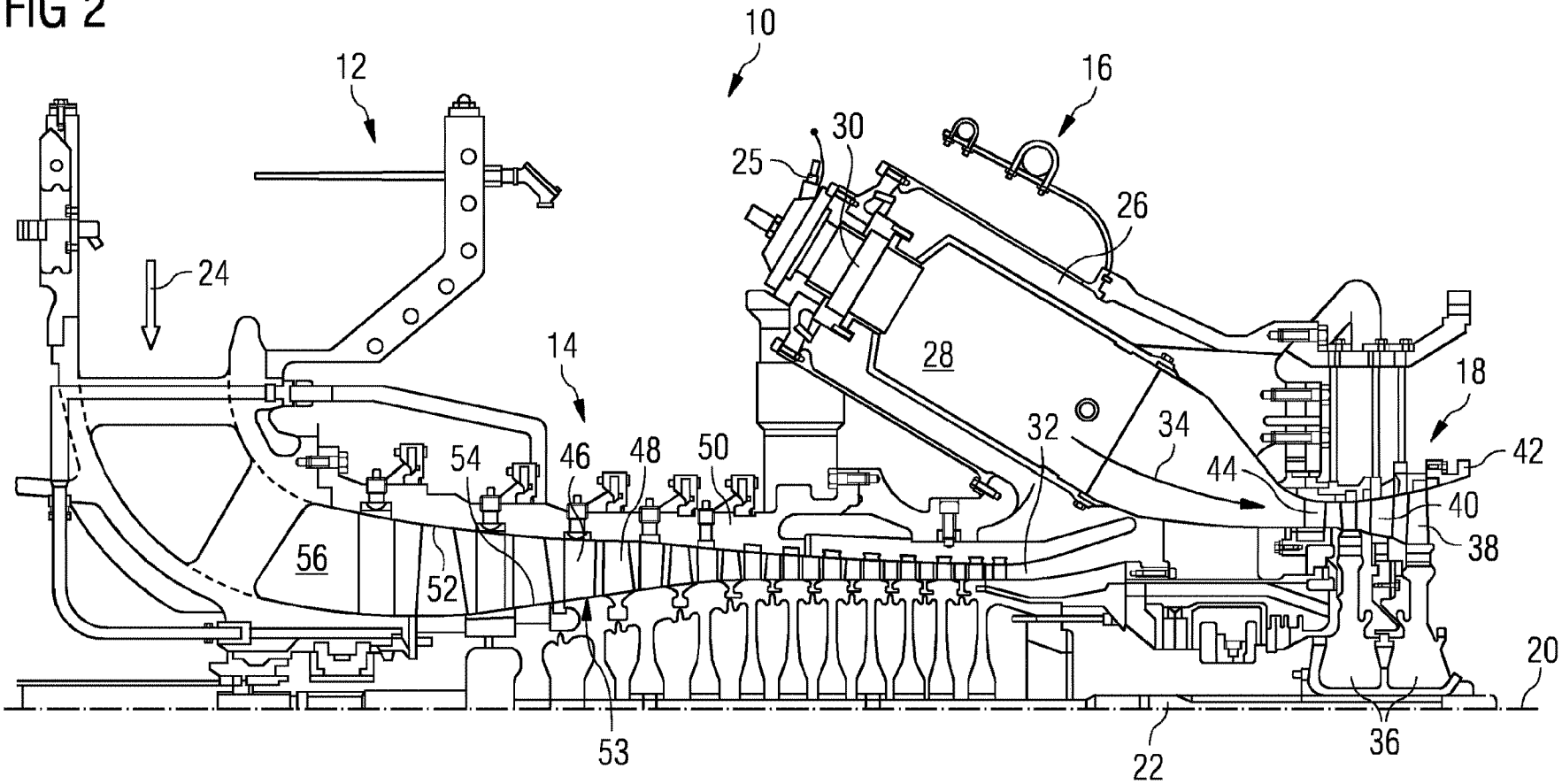
FIG. 2 shows part of a turbine engine in a sectional view and in which an aerofoil of the present disclosure may be provided.

FIG. 2 shows an example of a gas turbine engine 10 in a sectional view which may comprise an aerofoil and compressor rotor assembly of the present disclosure.

The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28.

The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the resulting combustion gas 34 or working gas from the combustion is channelled through the combustion chamber 28 to the turbine section 18.

The turbine section 18 comprises a number of blade carrying discs 36 attached to the shaft 22. In addition, guiding vanes 40, which are fixed to a stator 42 of the gas turbine engine 10, are disposed between the stages of annular arrays of turbine blades 38. Between the exit of the combustion chamber 28 and the leading turbine blades 38, inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

Compressor aerofoils (that is to say, compressor rotor blades and compressor stator vanes) have a smaller aspect ratio than turbine aerofoils (that is to say, turbine rotor blades and turbine stator vanes), where aspect ratio is defined as the ratio of the span (i.e. width) of the aerofoil to the mean chord (i.e. straight line distance from the leading edge to the trailing edge) of the aerofoil. Turbine aerofoils have a relatively large aspect ratio because they are necessary broader (i.e. wider) to accommodate cooling passages and cavities, whereas compressor aerofoils, which do not require cooling, are relatively narrow.

Compressor aerofoils also differ from turbine aerofoils by function. For example, compressor rotor blades are configured to do work on the air that passes over them, whereas turbine rotor blades have work done on them by exhaust gas which pass over them. Hence compressor aerofoils differ from turbine aerofoils by geometry, function and the working fluid which they are exposed to. Consequently, aerodynamic and/or fluid dynamic features and considerations of compressor aerofoils and turbine aerofoils tend to be different as they must be configured for their different applications and locations in the device in which they are provided.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 46. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48 and will be described in more detail below.

The aerofoil of the present disclosure is described with reference to the above exemplary turbine engine having a single shaft or spool connecting a single, multi-stage compressor and a single, one or more stage turbine. However, it should be appreciated that the aerofoil of the present disclosure is equally applicable to two or three shaft engines and which can be used for industrial, aero or marine applications. The term rotor or rotor assembly is intended to include rotating (i.e. rotatable) components, including rotor blades and a rotor drum. The term stator or stator assembly is intended to include stationary or non-rotating components, including stator vanes and a stator casing. Conversely the term rotor is intended to relate a rotating component, to a stationary component such as a rotating blade and stationary casing or a rotating casing and a stationary blade or vane. The rotating component can be radially inward or radially outward of the stationary component.

The terms axial, radial and circumferential are made with reference to the rotational axis 20 of the engine.

Figure 3:
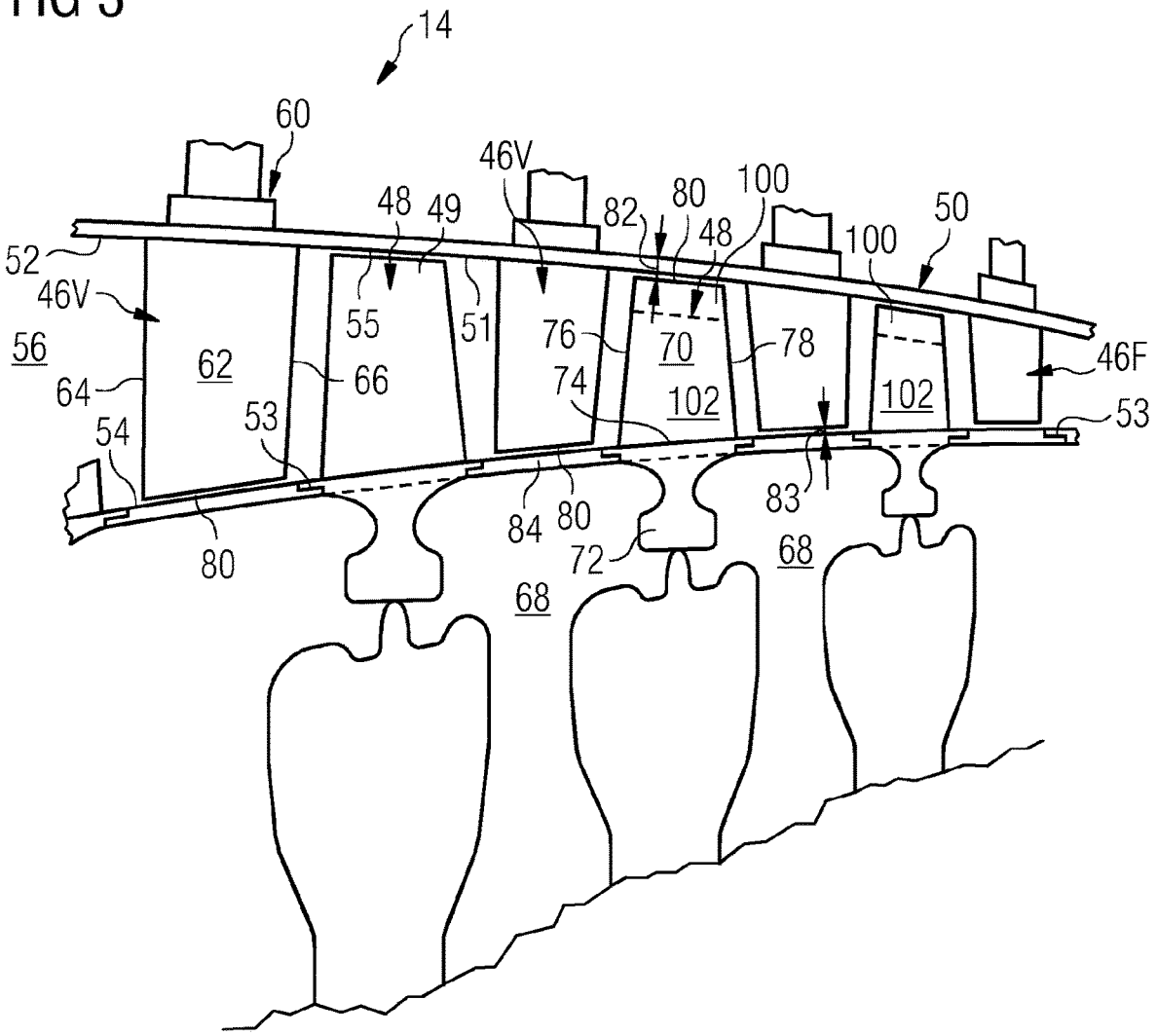
FIG. 3 shows an enlarged view of part of a compressor of the turbine engine of FIG. 2.

Referring to FIG. 3, the compressor 14 of the turbine engine 10 includes alternating rows of stator guide vanes 46 and rotatable rotor blades 48 which each extend in a generally radial direction into or across the passage 56.

The rotor blade stages 49 comprise rotor discs 68 supporting an annular array of blades. The rotor blades 48 are mounted between adjacent discs 68, but each annular array of rotor blades 48 could otherwise be mounted on a single disc 68. In each case the blades 48 comprise a mounting foot or root portion 72, a platform 74 mounted on the foot portion 72 and an aerofoil 70 having a leading edge 76, a trailing edge 78 and a blade tip 80. The aerofoil 70 is mounted on the platform 74 and extends radially outwardly therefrom towards the surface 52 of the casing 50 to define a blade tip gap, hg (which may also be termed a blade clearance 82).

The radially inner surface 54 of the passage 56 is at least partly defined by the platforms 74 of the blades 48 and compressor discs 68. In the alternative arrangement mentioned above, where the compressor blades 48 are mounted into a single disc the axial space between adjacent discs may be bridged by a ring 84, which may be annular or circumferentially segmented. The rings 84 are clamped between axially adjacent blade rows 48 and are facing the tip 80 of the guide vanes 46. In addition as a further alternative arrangement a separate segment or ring can be attached outside the compressor disc shown here as engaging a radially inward surface of the platforms.

FIG. 3 shows two different types of guide vanes, variable geometry guide vanes 46V and fixed geometry guide vanes 46F. The variable geometry guide vanes 46V are mounted to the casing 50 or stator via conventional rotatable mountings 60. The guide vanes comprise an aerofoil 62, a leading edge 64, a trailing edge 66 and a tip 80. The rotatable mounting 60 is well known in the art as is the operation of the variable stator vanes and therefore no further description is required. The guide vanes 46 extend radially inwardly from the casing 50 towards the radially inner surface 54 of the passage 56 to define a vane tip gap or vane clearance 83 there between.

Collectively, the blade tip gap or blade clearance 82 and the vane tip gap or vane clearance 83 are referred to herein as the 'tip gap hg'. The term 'tip gap' is used herein to refer to a distance, usually a radial distance, between the tip's surface of the aerofoil portion and the rotor drum surface or stator casing surface.

Although the aerofoil of the present disclosure is described with reference to the compressor blade and its tip, the aerofoil may also be provided as a compressor stator vane, for example akin to vanes 46V and 46F.

The present disclosure may relate to an un-shrouded compressor aerofoil and in particular may relate to a configuration of a tip of the compressor aerofoil to minimise aerodynamic losses.

The compressor aerofoil 70 comprises a suction surface wall 88 and a pressure surface wall 90 which meet at the leading edge 76 and the trailing edge 78. The suction surface wall 88 has a suction surface 89 and the pressure surface wall 90 has a pressure surface 91.

As shown in FIG. 3, the compressor aerofoil 70 comprises a root portion 72 spaced apart from a tip portion 100 by a main body portion 102.

Figure 4:
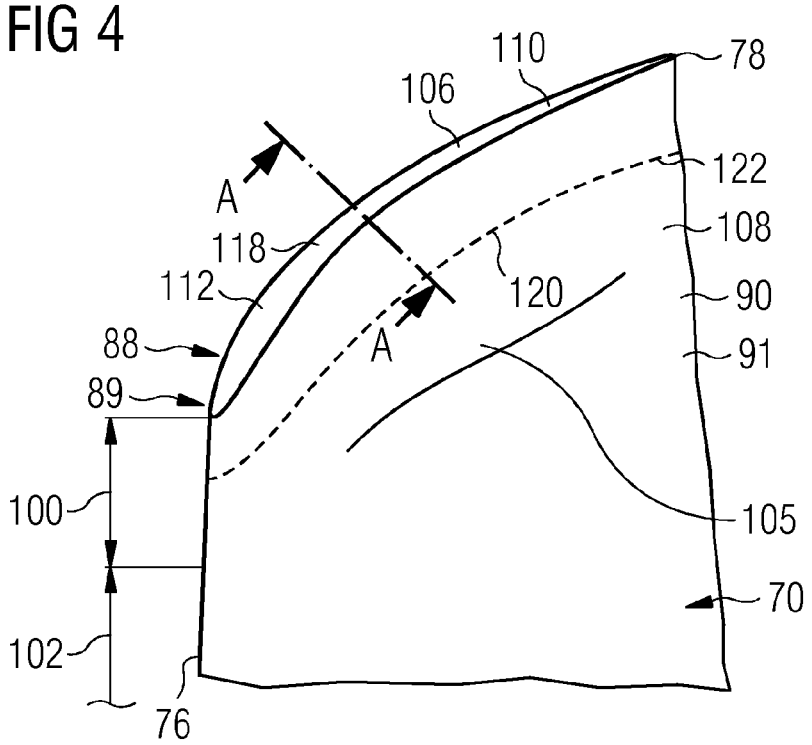
FIG. 4 shows part of a main body and a tip region of an example of an aerofoil according to the present disclosure.
Figure 5:
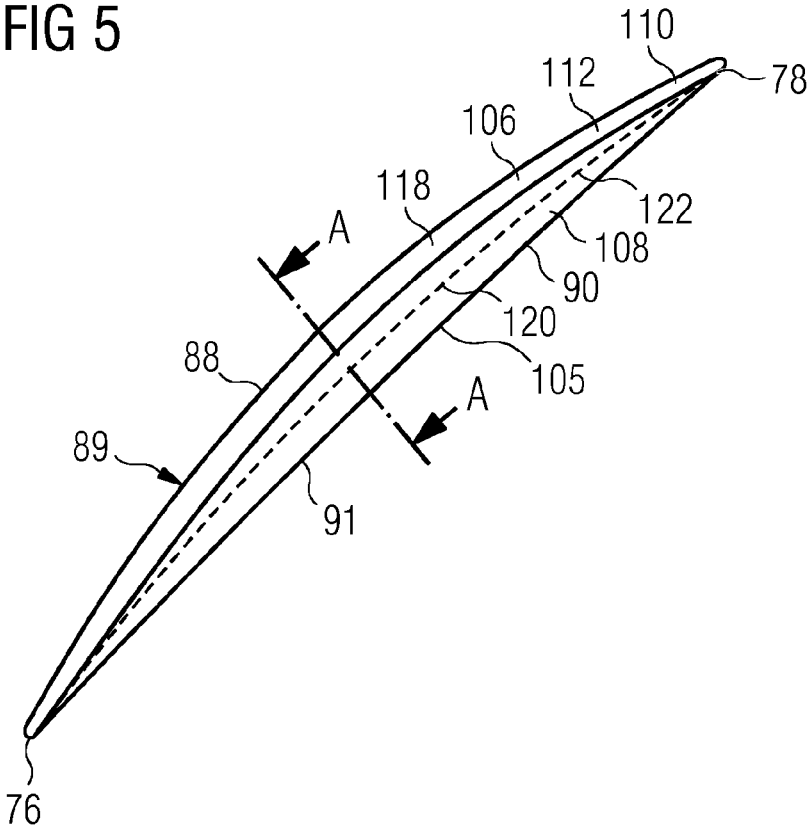
FIG. 5 shows an end on view of a part of the tip region of the aerofoil shown in FIG. 4.
Figures 6, 7:
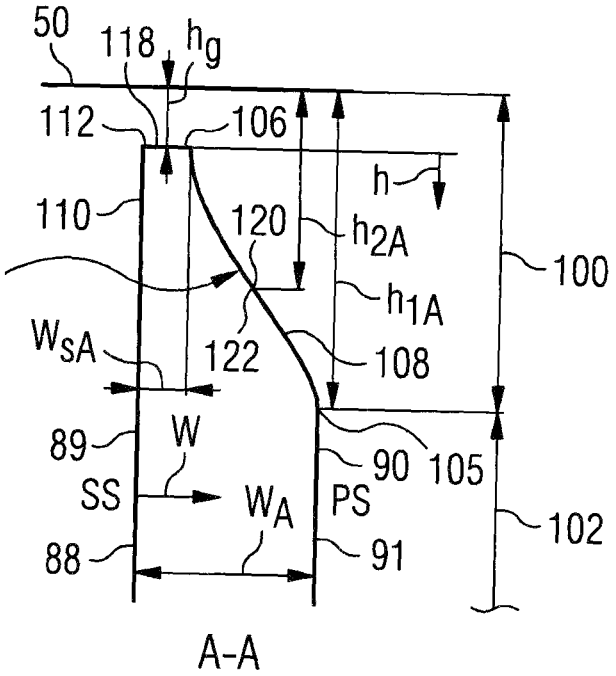
FIG. 6 shows a sectional view of the aerofoil as indicated at A-A in FIG. 5.
FIG. 7 is a table of relative dimensions of the features shown in FIG. 6.

FIG. 4 shows an enlarged view of part of a compressor aerofoil 70 according to one example of the present disclosure. FIG. 5 shows an end on view of a part of the tip region of the aerofoil 70. FIG. 6 shows a sectional view of the aerofoil at points A-A along a chord line of the aerofoil, for example as indicated in FIG. 4. FIG. 7 summarises the relationship between various dimensions as indicated in FIG. 6.

The main body portion 102 is defined by the convex suction surface wall 88 having a suction surface 89 and the concave pressure surface wall 90 having the pressure surface 91. The suction surface wall 88 and the pressure surface wall 90 meet at the leading edge 76 and at the trailing edge 78.

The tip portion 100 comprises a tip wall 106 which extends from the aerofoil leading edge 76 to the aerofoil trailing edge 78. The tip wall 106 defines a squealer 110.

In the example of FIG. 4, the tip portion 100 further comprises a shoulder 105 provided on the pressure surface wall 90, wherein the shoulder 105 extends between the leading edge 76 and the trailing edge 78. The tip portion 100 further comprises a transition region 108 which tapers from the shoulder 105 in a direction towards the tip wall 106.

The suction surface wall 88 extends all of the way towards the tip wall 106 such that the suction surface 89 extends all of the way to the tip wall 106. That is to say, in the tip section 100, the suction surface 89 extends in the same direction (i.e. with the same curvature) towards the tip wall 106 as it does in the main body portion 102. That is to say the suction surface 89 extends from the main body portion 102 without transition and/or change of direction towards the tip wall 106. Put another way a pressure side shoulder 105 is present, but no such shoulder is provided as part of the suction surface 89 in the present example.

The tip wall 106 defines a tip surface 118 which extends from the aerofoil leading edge 76 to the aerofoil trailing edge 78.

As shown in FIG. 6, the transition region 108 of the pressure surface wall 90 extends from the shoulder 105 in a direction towards the suction surface 89, and at a pressure side inflexion point 120 the transition region 108 curves to extend in a direction away from the suction surface 89 toward the tip surface 118.

As best shown in FIGS. 4, 5 the tip portion 100 further comprises a pressure surface inflexion line 122 defined by a change in curvature on the pressure surface 91, the pressure side inflexion point 120 being provided on the pressure side inflexion line 122, the pressure side inflexion line 122 extending all of the way from the leading edge 76 to the trailing edge 78.

Figure 8:
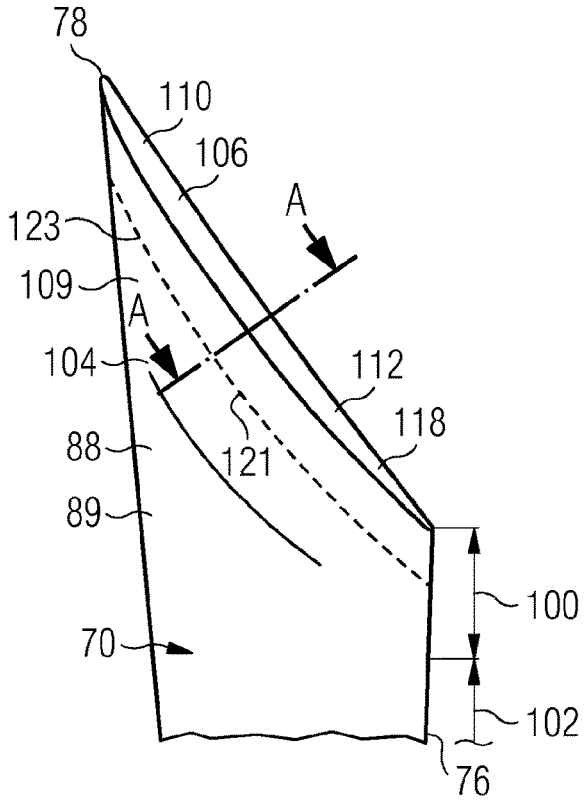
FIG. 8 shows part of a main body and a tip region of an alternative example of an aerofoil according to the present disclosure.
Figure 9:
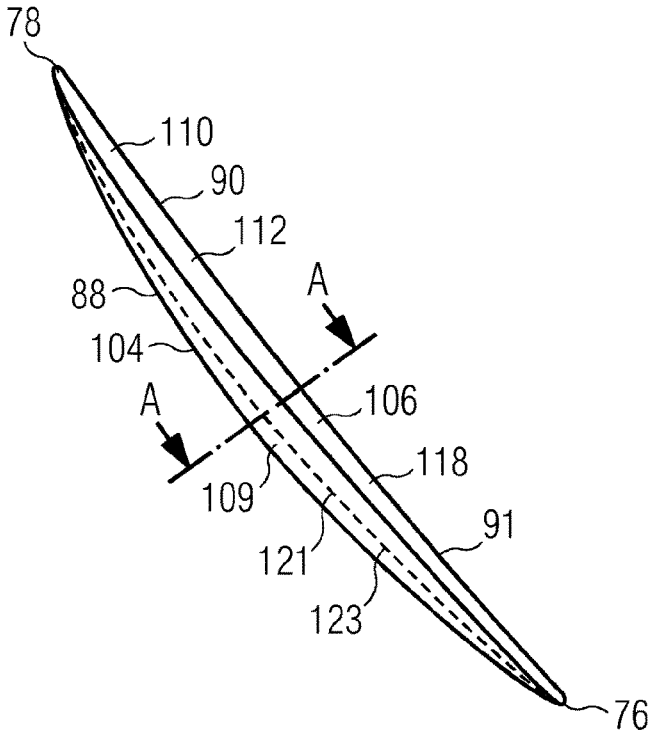
FIG. 9 shows an end on view of a part of the tip region of the aerofoil shown in FIG. 8.
Figures 10, 11:
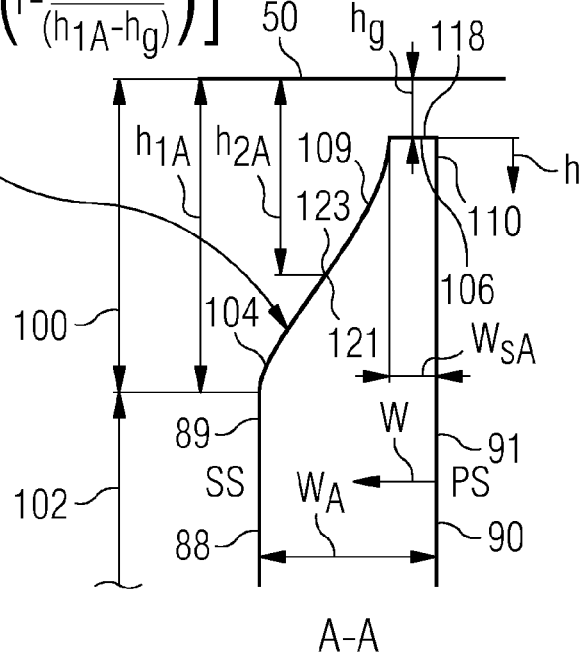
FIG. 10 shows a sectional view of the aerofoil as indicated at A-A in FIG. 9.
FIG. 11 is a table of relative dimensions of the features shown in FIG. 10.

FIG. 8 shows an enlarged view of part of a compressor aerofoil 70 according to an alternative example of the present disclosure. FIG. 9 shows an end on view of a part of the tip region of the aerofoil 70 of FIG. 8. FIG. 10 shows sectional views of the aerofoil at points A-A along a chord line of the aerofoil, for example as indicated in FIGS. 8, 9. FIG. 11 summarises the relationship between various dimensions as indicated in FIG. 10.

Features common to the example of FIGS. 4 to 7 are identified with the same reference numerals. The example of FIGS. 4 to 7 and FIGS. 8 to 11 are identical except that the tip wall 106 and squealer 110 of the FIGS. 4 to 7 example is provided towards the suction side 88 and the tip wall 106 and squealer 110 of the FIGS. 8 to 11 example is provided towards the pressure side 90.

In the example of FIG. 8, the tip portion 100 comprises a shoulder 104 provided on the suction surface wall 88, wherein the shoulder 104 extends between the leading edge 76 and the trailing edge 78. The tip portion 100 further comprises a transition region 109 which tapers from the shoulder 104 in a direction towards the tip wall 106.

The pressure surface wall 90 extends all of the way towards the tip wall 106 such that the pressure surface 91 extends all of the way to the tip wall 106. That is to say, in the tip section 100, the pressure surface 91 extends in the same direction (i.e. with the same curvature) towards the tip wall 106 as it does in the main body portion 102. That is to say the pressure surface 91 extends from the main body portion 102 without transition and/or change of direction towards the tip wall 106. Put another way a suction side shoulder 104 is present, but no such shoulder is provided as part of the pressure surface 91.

As shown in FIG. 10, the transition region 109 of the suction surface wall 88 extends from the shoulder 104 in a direction towards the pressure surface 91, and at a suction side inflexion point 121 the transition region 109 curves to extend in a direction away from the pressure surface 91 toward the tip surface 118.

As best shown in FIGS. 8, 9 the tip portion 100 further comprises a suction surface inflexion line 123 defined by a change in curvature on the suction surface 89, the suction side inflexion point 121 being provided on the suction side inflexion line 123, the suction side inflexion line 123 extending from the leading edge 76 all of the way to the trailing edge 78.

Hence the examples of FIGS. 4 to 7 and FIGS. 8 to 11 illustrate a compressor aerofoil 70 for a turbine engine which has a shoulder 104, 105 provided on only one of the suction surface wall 88 or pressure surface wall 90, wherein the shoulder 104, 105 extends between the leading edge 76 and the trailing edge 78. Hence the shoulder 104, 105 is provided on one of the suction surface wall 88 or pressure surface wall 90, but not both.

In both examples a transition region 108, 109 tapers from the shoulder 104, 105 in a direction towards the tip wall 106, and the other of the suction surface wall 88 or pressure surface wall 90 (that is, the one without the shoulder 104, 105) extends all of the way towards the tip wall 106, as described in each example above, such that the associated suction surface or pressure surface without the shoulder extends all of the way to the tip wall 106.

As shown in FIGS. 6, 10 the pressure surface 91 and the suction surface 89 are spaced apart by a distance which varies between the leading edge 76 and trailing edge 78. Hence $w_A$ is the distance between the pressure wall 90 and suction wall 88 at a section A-A at any point along a chord line of the aerofoil between the leading edge and trailing edge. Put another way, $w_A$ is the local thickness of the main body portion 102 a given location along the chord of the aerofoil that extends from the leading edge to the trailing edge.

For the avoidance of doubt, the term "chord" refers to an imaginary straight line which joins the leading edge 76 and trailing edge 78 of the aerofoil 70. Hence the chord length L is the distance between the trailing edge 78 and the point on the leading edge 76 where the chord intersects the leading edge.

The distance $w_A$ may have a maximum value at a region between the leading edge 76 and trailing edge 78.

The distance $w_A$ between the pressure surface 91 and the suction surface 89 may decrease in value from the maximum value towards the leading edge 76.

The distance $w_A$ between the pressure surface 91 and the suction surface 89 may decrease in value from the maximum value towards the trailing edge 78.

The tip wall 106 (i.e. squealer 110) may increase in width $w_{SA}$ along its length from the leading edge 76 and may increase in width $w_{SA}$ along its length from the trailing edge 78.

Put another way, the tip wall 106 may decrease in width $w_{SA}$ along its length towards the leading edge 76 and decrease in width $w_{SA}$ along its length towards the trailing edge 78.

The squealer width $w_{SA}$ may have a value of at least 0.3, but no more than 0.6, of the distance $w_A$ between pressure surface 91 and the suction surface 89 measured at the same section A-A of the main body portion 102.

That is to say the width $w_{SA}$ of the tip wall 106 has a value of at least 0.3, but no more than 0.6, of the distance $w_A$ measured at the same section on the chord between the leading edge and trailing edge.

The distance $w_A$ may vary in value along the length of the tip portion 100, and hence the distance $w_{SA}$ may vary accordingly.

With reference to a compressor rotor assembly for a turbine engine comprising a compressor aerofoil according to the present disclosure, and as described above and shown in FIGS. 6, 10 the compressor rotor assembly comprises a casing 50 and a compressor aerofoil 70 wherein the casing 50 and the compressor aerofoil 70 define a tip gap, hg, defined between the tip surface and the casing.

In such an example a distance $h_{2A}$ from the inflexion line 122, 123 to the casing 50 has a value of at least about 1.5, but no more than about 3.5, of the tip gap hg. Put another way the distance $h_{2A}$ from the inflexion line 122,123 to the casing 50 has a value of at least 1.5 hg but no more than 3.5 hg.

The respective shoulders 104, 105 of each example are provided a distance $h_{1A}$ from the casing 50, where $h_{1A}$ has a value of at least 1.5, but no more than 2.7, of distance $h_{2A}$. Put another way, the distance $h_{1A}$ has a value of at least 1.5 $h_{2A}$, but no more than 2.7 $h_{2A}$.

The distance "W" of a point on the transition region 108, 109 on one of the walls 88, 90 to the opposite wall without the transition region 108, 109 for a given height (distance) "h" from the tip surface 118 is defined by (Equation 1):

$$W = \beta \cdot (W_A - W_{SA})\left[\left[\sin\frac{\pi}{2\beta}\left(1 - \frac{h}{(h_{1A} - h_g)}\right)\right]^{\alpha}$$

Put another way, W is the spanned (i.e. shortest) distance between a point from one of the suction surface wall 88 or pressure surface wall 90 without the transition region 108, 109 to a point on the transition region 108, 109, at a given height h from the tip surface 118, as one moves along the surface of the transition region 108 between the shoulder 104 and tip surface 118.

Hence "h" is the distance between the shoulder 104 and tip surface 118.

In equation 1 factors α and β are introduced and ranges are given in the table shown in FIGS. 7 (and 11). Factor α is equal to or greater than 1 and is advantageously less than or equal to 5. An advantageous range of factor α is between and including 1.5 and 3. This range gives particularly good minimisation of aerodynamic losses. Factor β is equal to or greater than 1 and is advantageously less than or equal to 5. An advantageous range of factor β is between and including 1 and 2. This range give particularly good minimisation of aerodynamic losses and particularly in when factor α is between and including 1 and 2.

Figure 12:
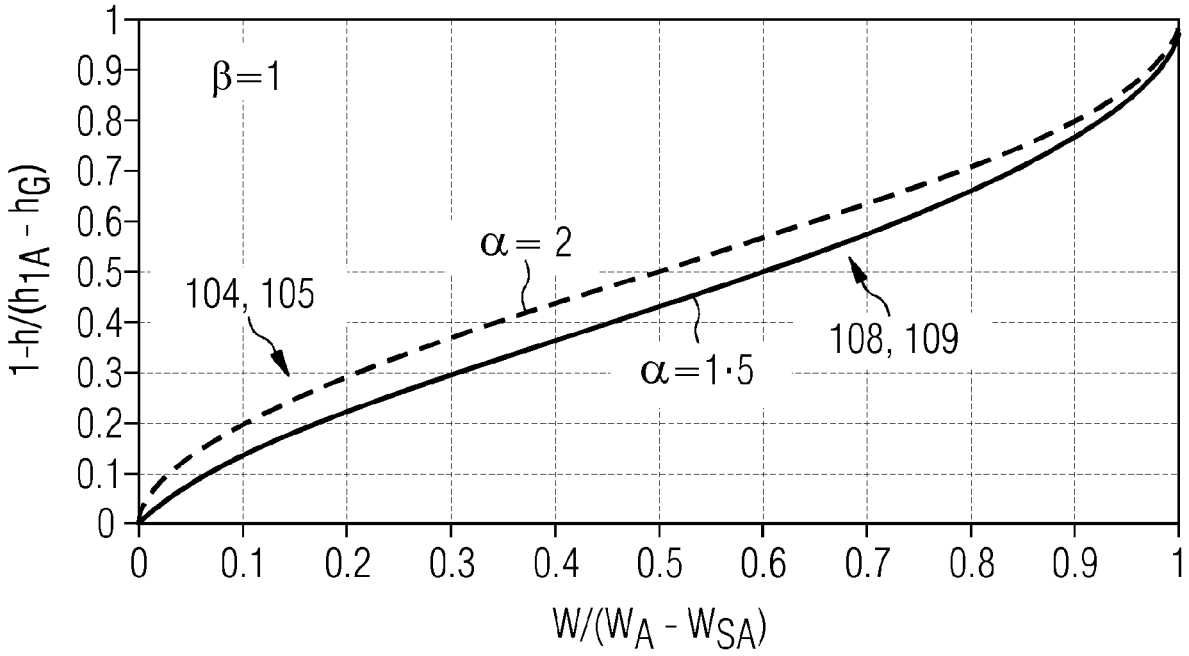
FIG. 12 shows a graphical representation of a number of possible profiles of the tip portion geometry in accordance with FIG. 10.

FIG. 12 shows a graphical representation of a number of possible profiles of the tip portion 100 geometry in accordance with FIG. 10 and equation 1 in view of its values given in FIG. 11. Similarly, the FIG. 10 embodiment may also be applied to the profile shown in FIG. 6 and values of FIG. 7. In particular, here β=1 and two profiles (of the shoulder 104 or 109 and transition portion 108 or 109 respectively) are generated where α=1.5 and 2.

Figure 13:
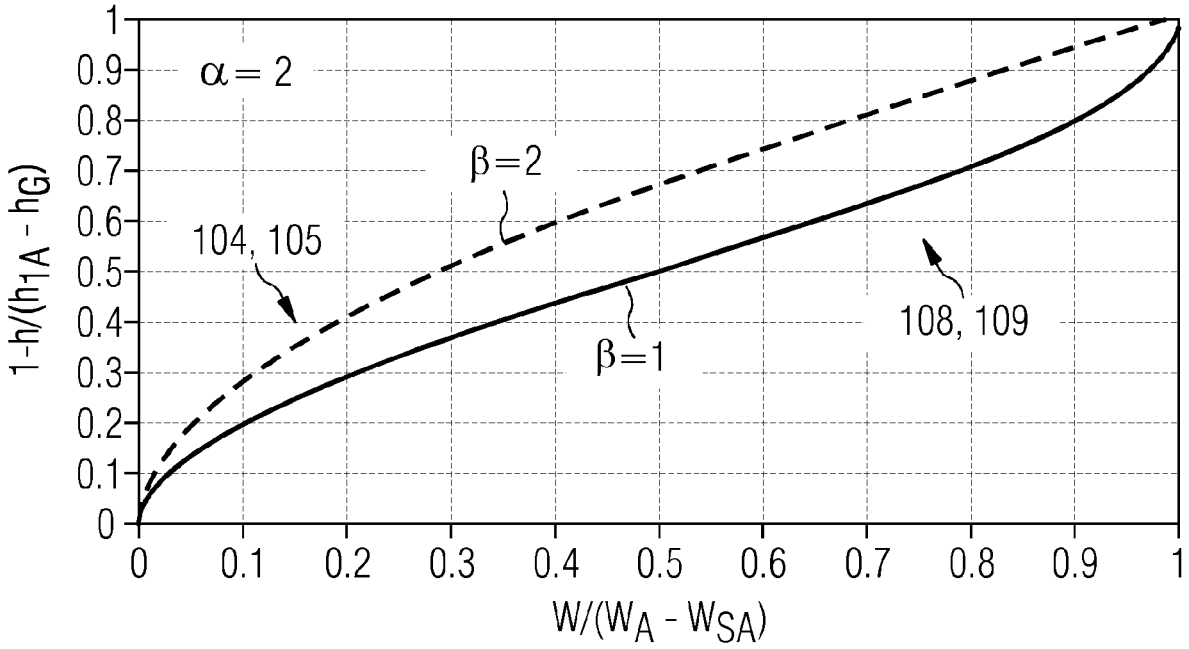
FIG. 13 shows a graphical representation of a number of possible profiles of the tip portion geometry in accordance with FIG. 10.

FIG. 13 shows a graphical representation of a number of possible profiles of the tip portion 100 geometry in accordance with FIG. 10 and equation 1 in view of its values given in FIG. 11. Similarly, the FIG. 10 embodiment may also be applied to the profile shown in FIG. 6 and values of FIG. 7. In particular, here α=2 and two profiles (of the shoulder 104 or 109 and transition portion 108 or 109 respectively) are generated where β=1 and 2.

In general and in accordance with equation 1 and referring to FIGS. 10 (and 6), the distance $h_{2A}$ from the inflexion line 122, 123 to the casing 50 has a value of at least 1.5, but no more than 3.5, of the tip gap hg. Put another way, the distance $h_{1A}$ has a value of at least 1.5 $h_{2A}$, but no more than 2.7 $h_{2A}$. The respective shoulders 104, 105 of each example are provided a distance $h_{1A}$ from the casing 50, where $h_{1A}$ has a value of at least 1.5, but no more than 2.7, of distance $h_{2A}$. Put another way, the distance $h_{1A}$ has a value of at least 1.5 $h_{2A}$, but no more than 2.7 $h_{2A}$.

Figure 14:
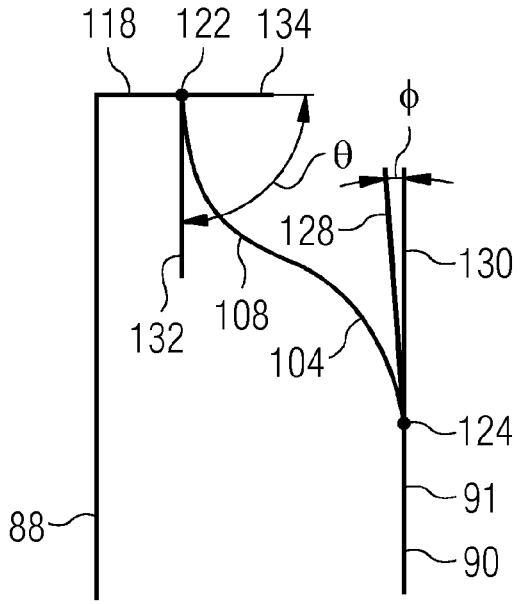
FIG. 14 shows a sectional view of the aerofoil as indicated at A-A in FIG. 5.

FIG. 14 is a sectional view of the aerofoil as indicated at A-A in FIG. 5. As can be seen the sectional profile of the present tip portion 100, which comprises the shoulder 105 and the transition region 108, is further defined by the intersections 120, 122 with the pressure surface wall 90 (or suction surface wall 88) and the transition region 108 (and 109) respectively. In the cross-section shown, there is a smooth blend 124 formed by the shoulder 104, 105 and the pressure surface wall 90 (or suction surface wall 88). The smooth blend 124 comprises the intersection 120 having an angle ϕ defined between tangents 128 and 130 of the shoulder 104, 105 and the pressure surface wall 90 (or the suction surface wall (88). The angle ϕ is 0°, i.e. the tangents 128, 130 are coincident, but the angle ϕ may be up to 5°. Thus where the angle ϕ is 0° the surface of the shoulder blends completely smoothly into the pressure or suction wall's surface. This smooth blend ensures that air passing over this region has minimal aerodynamic disturbance. Angles ϕ up to 5° cause an acceptable level of disturbance to the air flow.

The transition region 108, 109 forms a discontinuous curve 126 with the tip surface 118. In the cross-section shown, the tip surface 118 is advantageously straight. The discontinuous curve 126 comprises the intersection 122 formed where the transition region 104, 105 and the tip surface 118 meet. Respective tangents 132, 134 of the transition region 104, 105 and the tip surface 118 have an angle θ which is 90°. The intersection 122 and considering its extent along the aerofoil's length between leading and trailing edges forms a sharp edge. In other examples, the angle θ may be between 45° and 90° which still provides a sharp edge. Thus the term discontinuous curve 126 is intended to mean that there is a sharp edge. The sharp edge or discontinuous curve 126 minimises over tip leakage by virtue of causing turbulence in the airflow over the sharp edge such that the turbulence increases the static pressure above the tip surface 118. The increase in static pressure above the tip surface 118 inhibits over tip leakage and therefore improves efficiency of the aerofoil.

The values given in FIG. 7 and FIG. 11 for equations 1 give rise to tip profiles within the above described geometry of FIG. 14.

Figure 1:
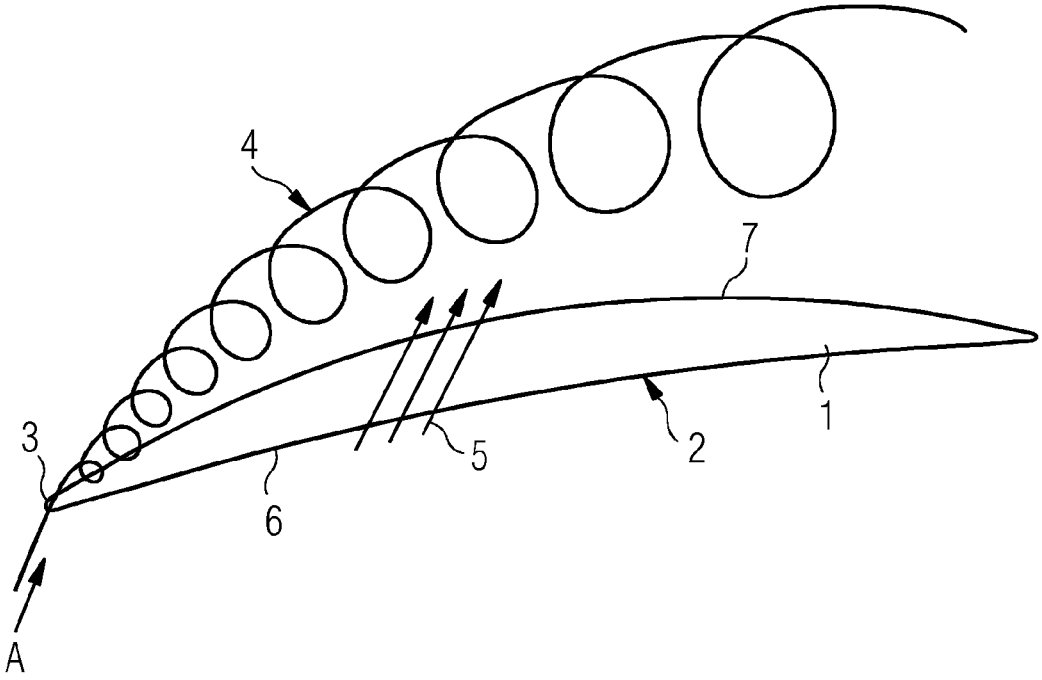
FIG. 1 shows an example aerofoil tip, as discussed in the background section.

In operation in a compressor, the geometry of the compressor aerofoil of the present disclosure differs in two ways from arrangements of the related art, for example as shown in FIG. 1.

In both the examples of FIGS. 4 to 7 and FIGS. 8 to 11, the inflexions 120, 121 (i.e. inflexion lines 122, 123) in the transition regions 108, 109 which form the tip wall region of the squealer 110 inhibit primary flow leakage by reducing the pressure difference across the tip wall 106 leading edge 76 and hence the loss due to tip flow is lower.

The squealer 110, being narrower than the overall width of the main body 102, causes the pressure difference across the tip surface 118 as a whole to be lower than if the tip surface 118 had the same cross section as the main body 102. Hence secondary leakage flow across the tip surface 118 will be less than in examples of the related art, and the primary tip leakage flow vortex formed is consequently of lesser intensity as there is less secondary leakage flow feeding it than in examples of the related art.

Additionally, since the squealer 110 of the aerofoil 70 is narrower than the walls of main body 102, the configuration is frictionally less resistant to movement than an example of the related art in which aerofoil tip has the same cross-section as the main body (for example as shown in FIG. 1). That is to say, since the squealer 110 of the present disclosure has a relatively small surface area, the frictional and aerodynamic forces generated by it with respect to the casing 50 will be less than in examples of the related art.

Thus, the amount of over tip leakage flow flowing over the tip surface 118 is reduced, as is potential frictional resistance. The reduction in the amount of secondary tip leakage flow is beneficial because there is then less interaction with (e.g. feeding of) the over tip leakage vortex.

Hence there is provided an aerofoil rotor blade and/or stator vane for a compressor for a turbine engine configured to reduce tip leakage flow and hence reduce strength of the interaction between the leakage flow and the main stream flow which in turn reduces overall loss in efficiency.

As described, the aerofoil is reduced in thickness towards its tip to form a squealer portion on the suction (convex) side of the aerofoil (as shown in FIGS. 4 to 7) or the pressure (concave) side of the aerofoil (as shown in FIGS. 8 to 11) which extends from the its leading edge towards the trailing edge. This arrangement reduces the pressure difference across the tip and hence reduces secondary leakage flow. This arrangement, especially near the leading edge, acts to diminish primary leakage flow, and hence reduces tip leakage mass flow thereby diminishing the strength of the interaction between the leakage flow and the main stream flow which in turn reduces the loss in efficiency.

Hence the compressor aerofoil of the present disclosure results in a compressor of greater efficiency compared to known arrangements.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A compressor aerofoil for a turbine engine, the compressor aerofoil comprising:

a tip portion which extends from a main body portion;

the main body portion defined by:

a suction surface wall having a suction surface, a pressure surface wall having a pressure surface, whereby the suction surface wall and the pressure surface wall meet at an aerofoil leading edge and an aerofoil trailing edge, the tip portion comprising:

a tip wall which extends from the aerofoil leading edge to the aerofoil trailing edge;

the tip wall defining a squealer and having a tip surface; and one of the suction surface wall or the pressure surface wall extends towards the tip wall such that a respective one of the suction surface or the pressure surface extends to the tip wall;

a shoulder is provided only on the other of the suction surface wall or the pressure surface wall, but not both the suction surface wall and the pressure surface wall;

wherein the shoulder extends from the aerofoil leading edge to the aerofoil trailing edge; and a transition region tapers from the shoulder in a direction to the tip wall, wherein, in cross-section, there is a smooth blend formed by the shoulder and the other of the suction surface wall or the pressure surface wall, and the transition region forms a discontinuous curve with the tip surface, wherein the smooth blend comprises an intersection having an angle ($\phi$) defined by a tangent of the shoulder and a tangent of the other of the suction surface wall or the pressure surface wall, wherein the discontinuous curve comprises an intersection having an angle ($\theta$) defined by a tangent of the transition region and a tangent of the tip surface, the tangent of the transition region and the tangent of the tip surface each at the intersection having the angle ($\theta$), wherein the profile of the tip portion is defined by a concave portion that blends into the intersection having the angle ($\phi$) and by a convex portion that blends into the intersection having the angle ($\theta$).

2. The compressor aerofoil as claimed in claim 1, wherein:

the shoulder is provided on the suction surface wall;

the tip surface extends from the aerofoil leading edge to the aerofoil trailing edge;

the transition region of the suction surface wall extends from the shoulder in a direction towards the pressure surface, and at a suction side inflexion point the transition region curves to extend in a direction away from the pressure surface toward the tip surface.

3. The compressor aerofoil as claimed in claim 1, wherein the tip portion further comprises:

a suction side inflexion line defined by a change in curvature on the suction surface; and the suction side inflexion point being provided on the suction side inflexion line;

the suction side inflexion line extending between the aerofoil trailing edge and the aerofoil leading edge.

4. The compressor aerofoil as claimed in claim 1, wherein the shoulder is provided on the pressure surface wall; and the suction surface extends to the tip wall.

5. The compressor aerofoil as claimed in claim 4, wherein:

the tip wall defines a tip surface which extends from the aerofoil leading edge to the aerofoil trailing edge;

the transition region of the pressure surface wall extends from the shoulder in a direction towards the suction surface, and at a pressure side inflexion point the transition region curves to extend in a direction away from the suction surface toward the tip surface.

6. The compressor aerofoil as claimed in claim 5, wherein the tip portion further comprises:

a pressure side inflexion line defined by a change in curvature on the pressure surface;

the pressure side inflexion point being provided on the pressure side inflexion line; the pressure side inflexion line extending between the aerofoil leading edge and the aerofoil trailing edge.

7. The compressor aerofoil as claimed in claim 1, wherein:

the pressure surface and the suction surface are spaced apart by a distance ($W_A$);

the distance ($W_A$) having a maximum value at a region between the aerofoil leading edge and trailing edge;

the distance ($W_A$) between the pressure surface and the suction surface decreases in value from the maximum value towards the aerofoil leading edge; and the distance ($W_A$) between the pressure surface and the suction surface decreases in value from the maximum value towards the aerofoil trailing edge.

8. The compressor aerofoil as claimed in claim 7, wherein:

the tip wall increases in width ($W_{SA}$) along its the length of the tip wall from the aerofoil leading edge; and increases in width ($W_{SA}$) along its the length the tip wall from the aerofoil trailing edge.

9. The compressor aerofoil as claimed in claim 7, wherein:

the width ($W_{SA}$) of the tip wall, has a value of at least 0.3, but no more than 0.6, of the distance ($W_A$).

10. A compressor rotor assembly for a turbine engine, comprising:

a casing, and a compressor aerofoil as claimed in claim 9, wherein the casing and the compressor aerofoil define a tip gap (hg) defined between the tip surface and the casing.

11. The compressor rotor assembly as claimed in claim 10, wherein:

a distance $h_{2A}$ from one of a pressure side inflexion line and or a suction side inflexion line to the casing has a value of at least 1.5 the tip gap (hg) but no more than 3.5 the tip gap (hg).

12. The compressor rotor assembly as claimed in claim 11, wherein:

the shoulder is provided a distance ($h_{1A}$) from the casing;

where $h_{1A}$ has a value of at least 1.5, but no more than 2.7, of distance ($h_{2A}$).

13. The compressor rotor assembly as claimed in claim 12, wherein:

a distance (W) of a point on the transition region to the suction surface wall or pressure surface wall without the transition region for a given height (h) from the tip surface is defined by:

$$W = \beta \cdot (W_A - W_{SA})\left[\left[\sin\frac{\pi}{2\beta}\left(1 - \frac{h}{(h_{1A} - h_g)}\right)\right]\right]^{\alpha}$$

where α has a value greater than or equal to 1 and less than or equal to 5, where β has a value greater than or equal to 1 and less than or equal to 5.

14. The compressor aerofoil as claimed in claim 2, wherein the angle (ϕ) is 0°.

15. The compressor aerofoil as claimed in claim 2, wherein the angle (ϕ) is less than or equal to 5°.

16. The compressor aerofoil as claimed in claim 3, wherein the angle θ is 90°.

17. The compressor aerofoil as claimed in claim 3, wherein the angle (θ) is between 45° and 90°.

18. The compressor rotor assembly as claimed in claim 13, where α has a value less than or equal to 5.

19. The compressor rotor assembly as claimed in claim 13, where (α) has a value in a range between 1.5 and 3.

20. The compressor rotor assembly as claimed in claim 13, where (β) has a value less than or equal to 5.

21. The compressor rotor assembly as claimed in claim 13, where (β) is between 1 and 2.

* * * * *